US005510772A

United States Patent [19]

Lasenby

[11] Patent Number: 5,510,772

[45] Date of Patent: Apr. 23, 1996

[54] FLAME DETECTION METHOD AND APPARATUS

[75] Inventor: Joan Lasenby, Hardwick, United Kingdom

[73] Assignee: Kidde-Graviner Limited, Derby, United Kingdom

[21] Appl. No.: 102,388

[22] Filed: Aug. 5, 1993

[30] Foreign Application Priority Data

Aug. 7, 1992 [GB] United Kingdom ..... 9216811

[51] Int. Cl.[6] ..... G08B 17/12

[52] U.S. Cl. ..... 340/578; 250/554; 348/82; 382/295

[58] Field of Search ..... 340/577–578, 340/587–588; 348/82; 250/554; 382/1, 69, 41, 48, 49, 54

[56] References Cited

U.S. PATENT DOCUMENTS

| | | | |
|---|---|---|---|
| 4,520,390 | 5/1985 | Paredes et al. | 348/164 X |
| 4,533,834 | 8/1985 | McCormack | 250/554 |
| 4,737,844 | 4/1988 | Kohola et al. | 348/83 |
| 4,907,281 | 3/1990 | Hirvonen et al. | 340/577 X |
| 5,153,722 | 10/1992 | Goedeke et al. | 348/159 |
| 5,249,954 | 10/1993 | Allen et al. | 348/83 X |
| 5,289,275 | 2/1994 | Ishii et al. | 340/578 X |

*Primary Examiner*—Thomas Mullen
*Attorney, Agent, or Firm*—Leydig, Voit & Mayer

[57] ABSTRACT

A flame detection apparatus and method includes a camera, preferably operating in the near I.R. which produces a succession of images of a space to be monitored. The image intensity of each pixel in each image is converted to a binary value by comparing it with the average intensity value for that image. For each pixel in an image the average intensity value for all of the images is calculated. The binary intensity value of each pixel in an image is then compared with the binary intensity value of the corresponding pixels in all the other images to produce a crossing frequency value dependent on the number of times those binary values change state. The average intensity values and the crossing frequency values are then processed for each pixel according to a predetermined relationship to produce a constant. If the values of this constant for a cluster of adjacent pixels are found to be the same or nearly so, this is considered to indicate a flame. The crossing frequency values may be processed to eliminate those values lying outside a frequency range corresponding to flames so as to eliminate the corresponding pixels from the final assessment step.

42 Claims, 9 Drawing Sheets

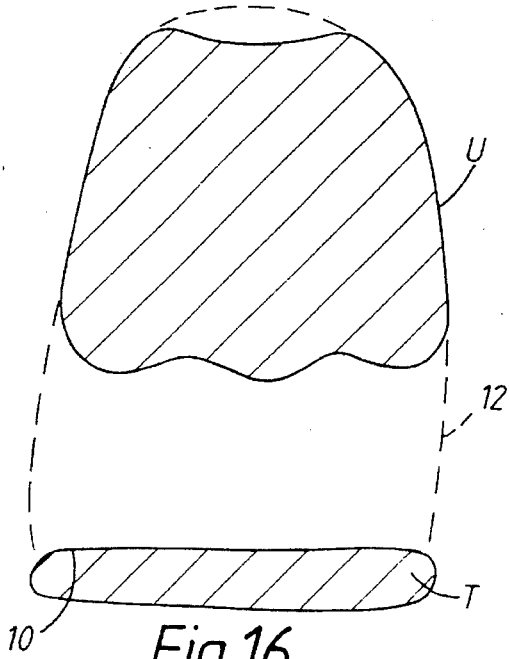
Fig.16.
| | | |
|---|---|---|
| 81 | 82 | 83 |
| 84 | 80 | 85 |
| 86 | 87 | 88 |
Fig.18.
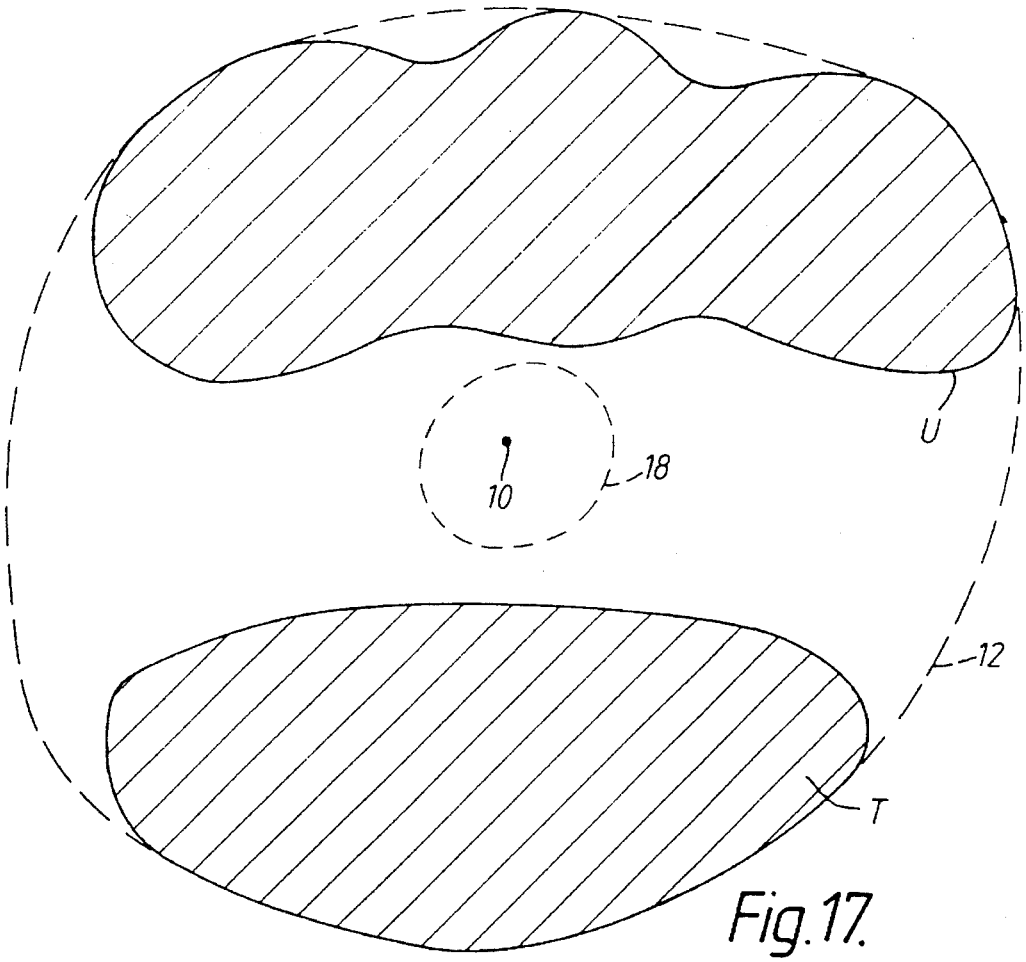
Fig.17.

FLAME DETECTION METHOD AND APPARATUS

BACKGROUND OF THE INVENTION

The invention relates to flame detecting methods and apparatus. Embodiments of the invention to be described in more detail below can be used for detecting fires within a monitored area and for producing an alarm in response to such detection.

BRIEF SUMMARY OF THE INVENTION

According to the invention, there is provided a method of detecting flames within a monitored space, comprising the steps of viewing the space so as to produce a sequence of successive two-dimensional images of it in terms of the electromagnetic radiation received from it; measuring the binary value of the intensity of the radiation, with respect to a threshold, in each of a plurality of predetermined parts of each image, the parts of each image forming a two-dimensional array; for each said part in one image and the corresponding parts in the other images calculating the average of the binary values of the intensity for all the sequence of measurements; for each said part in one image and the corresponding parts in the other images determining the value of a predetermined function of the autocorrelation function of the binary values of the intensity; and testing the said average intensity value and the value of the said predetermined function against a predetermined relationship therebetween corresponding to the presence of a flame in the monitored space whereby to determine whether or not the said values indicate the presence of a flame.

According to the invention, there is also provided a method of detecting fires within a monitored space, comprising the steps of: receiving electromagnetic radiation from the space; producing a predetermined sequence of successive two-dimensional images of the space in which each image is made up of respective image intensity values each corresponding to the intensity of the electromagnetic radiation from a respective part of the space; for each image comparing the measured intensity value of each said part with a threshold image value for that image whereby to assign a binary image value to each part of that image according as to whether the measured intensity value for that part is above or below the threshold value; for each said image part determining the average value of its binary intensity values in all of the images whereby to produce an "average progress variable" term C; for each image part determining the count of the number of times that its binary intensity value changes in all the images and dividing this count by the number of images so as to produce a "crossing frequency" term v; for at least each of selected ones of the image parts, testing the values of v and C against the relationship $$v=KC(1-C)$$

where K is a constant; and signalling the existence of a fire for any cluster of adjacent image parts for which the respective values of v and C fit the said relationship within predetermined limit values.

According to the invention, there is provided a method of detecting flames within a monitored space, comprising the steps of: viewing the space so as to produce a sequence of successive two-dimensional images of it in terms of the electromagnetic radiation received from it; for each part in each image of the sequence and the corresponding parts in the other images determining the magnitude of the average value of the intensity of rite radiation so as to produce a resultant set of the said average values, each average value in the set corresponding to a particular point in each of the two-dimensional images of the space; and assessing the relationship between the magnitudes of at least some of the average valises the set and comparing that relationship with a predetermined relationship to determine whether any of the average values in the set indicate the presence of a flame in the space.

According to the invention, there is further provided apparatus for detecting flames within a monitored space, comprising: means for viewing the space so as to produce a sequence of successive two-dimensional images of it in terms of the electromagnetic radiation received from it; measuring means for measuring the binary value of the intensity of the radiation, with respect to a threshold, in each of a plurality of predetermined parts of each image; the parts of each image forming a two-dimensional array; calculating means for calculating, for each said part in one image and the corresponding parts in the other images, the average of the binary values of the intensity for all the sequence of measurements; means for determining, for each said part in one image and the corresponding parts in the other images, the value of a predetermined function of the autocorrelation function of the binary values of the intensity; and testing means for testing the said average intensity value and the value of the said function against a predetermined relationship therebetween corresponding to the presence of a flame in the monitored space whereby to determine whether or not the said values indicate the presence of a flame.

According to the invention, there is still further provided apparatus for detecting fires within a monitored space, comprising: a camera for producing a predetermined sequence of successive two-dimensional images of the space in which each image is made up of respective image intensity values each corresponding to a respective two-dimensional part of the image; comparing means for comparing, in each image, the measured intensity value of each said part with a threshold image value for that image whereby to assign a binary image value to each part of that image according as to whether the measured intensity value for that part is above or below the threshold value; means for determining, for each said image part, the average value of its binary intensity values in all of the images whereby to produce an "average progress variable" term C; means of determining, for each image part, the count of the number of times that its binary intensity value changes in all the images and dividing this count by the number of images so as to produce a "crossing frequency" term v; means for testing, for at least each of selected ones of the image parts, the values of v and C against the relationship $$v=KC(1-C)$$

where K is a constant; and means for signalling the existence of a fire for any cluster of adjacent image parts for which the respective values of v and C fit the said relationship within predetermined limit values.

According to the invention, there is provided a method of detecting flames within a monitored space, comprising the steps of: viewing the space so as to produce a sequence of successive two-dimensional images of it in terms of the electromagnetic radiation received from it; for each part in each image of the sequence and the corresponding parts in the other images, determining a magnitude corresponding to the average value of the intensity of the radiation so as to produce a resultant set of the said average values, each average value in the set corresponding to a particular point in each of the two-dimensional images of the space; and assessing the relationship between the magnitudes of at least some of the average values in the set and comparing that relationship with a predetermined relationship to determine whether any of the average values in the set indicate the presence of a flame in the space.

According to the invention, there is further provided apparatus for detecting flames within a monitored space, comprising: means for viewing the space and producing a sequence of successive two-dimensional images of it in terms of the electromagnetic radiation received from it; processing means operative for each part in each image of the sequence and the corresponding parts in the other images to determine a magnitude corresponding to the average value of the intensity of the radiation so as to produce a resultant set of the said average values, each average value in the set corresponding to a particular point in each of the two-dimensional images of the space; and assessing and comparing means operative to assess the relationship between the magnitudes of at least some of the average values in the set and to compare that relationship with a predetermined relationship to determine whether any of the average values in the set indicate the presence of a flame in the space.

BRIEF DESCRIPTION OF THE DRAWINGS

Flame detecting methods and apparatus according to the invention will now be described, by way of example only, with reference to the accompanying diagrammatic drawings in which:

FIGS. 15, 16 and 17 illustrate further results of the operations both on radiation produced by a flame and a radiation from a non-flame source;

FIG. 18 illustrates another operation carried out by the second form of the apparatus.

DESCRIPTION OF PREFERRED EMBODIMENT

In the apparatus to be described, a space S to be monitored for the outbreak of a fire is viewed by a video camera 5. Camera 5 may operate at normal visual wavelengths, in the near infra-red region or in the mid infra-red region. In one example, the camera 5 is a CCD (charge-coupled device) camera. Advantageously, it is used in conjunction with a filter which cuts off radiation at wavelengths below 850 nm. This cuts out all visual wavelengths and the resultant images produced by the camera are therefore in the near infra-red region.

The camera thus produces a sequence of frames or images of the scene. Successive such images will be referred to as $F_1, F_2, F_3 \ldots F_n$. If a fire develops in the space S, the resultant flame will be seen by the camera and will thus appear in the images produced by the camera. The apparatus to be described processes the successive images in order to detect the changes produced in such images by such a flame, while at the same time discriminating against other sources of near infra-red radiation in the space S which might produce false alarms, such as solar radiation, a torch or other moving source of artificial light, or light reflected off a moving surface.

Figure 2:
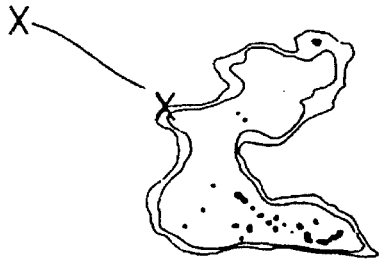
FIG. 2 illustrates a flame.

FIG. 2 shows such a flame. The boundary of the flame is the boundary between burning material and unburnt material. The boundary of the flame will thus move in a fluctuating manner. Thus, a particular region of the boundary will expand outwardly as flammable mixture adjacent to the immediately previous boundary at that part starts to burn. Then, when such mixture is fully burnt, the boundary in this region will recede, expanding again later as more unburnt mixture arrives in the region and is then burnt. Adjacent regions of the boundary will undergo the same process, but not of course necessarily in phase. Such fluctuations in the boundary will be apparent by comparing successive images produced by the camera.

Each fixed point in space, x, (see FIG. 2) is considered and the intensity is measured for this point at each of a sequence of successive time instants, each corresponding to a respective one of a sequence of successive images produced by the camera. The intensity is then compared with a threshold to produce a term c called the progress variable. The variable c is given a value c=0 when there is unburnt mixture (reactants) at point x, and is given a value c=1 when the mixture at that point is fully burnt (products). For each point x, therefore, c fluctuates in time between 0 and 1 as the flame boundary expands and recedes. Measurement of successive values of c thus enables an "average progress variable" to be established. This is the average value of c (thus lying between 0 and 1) for a series of successive images and is denoted as C.

In addition, for each image point x which has C values not equal to 0 or 1, certain functions of the autocorrelation function (referred to as P) of c can be measured, one such being the mean crossing frequency v, which is the number of times that the value of c for the point x changes between 0 and 1, or between 1 and 0, divided by the number of successive images and this is equivalent to P evaluated at lag 1 (that is, for the immediately succeeding image).

The theory of premixed turbulent combustion predicts a number of relationships between C and functions of P, one of which is the following relation between C and v:

$$v=KC(1-C) \tag{1}$$

where K is a constant.

Thus, in a cluster which corresponds to the position where a flame exists, it is expected that the values of v and C at the points in that cluster will be a good fit to the above parabola, and similarly it is expected that the relationships between other functions of P and C will be well-fitted by points in the cluster. Therefore, in a manner to be described in more detail, the camera views the space S and produces a succession of images of it. For each such sequence of images, the apparatus looks at all identified clusters and determines if the values of C, v, and functions of P etc., associated with the points of a cluster, are good fits to the relationships of which v=KC(1−C) is an example. If such a cluster with the required good-fits is found, this cluster is considered to represent a flame and an alarm is signalled. If required, an additional check can be invoked which involves using pattern recognition techniques to confirm or otherwise that the shape of the cluster (as defined by values of C not equal to 0 or 1) matches the very distinct shapes produced by a wide variety of flames.

Figure 3:
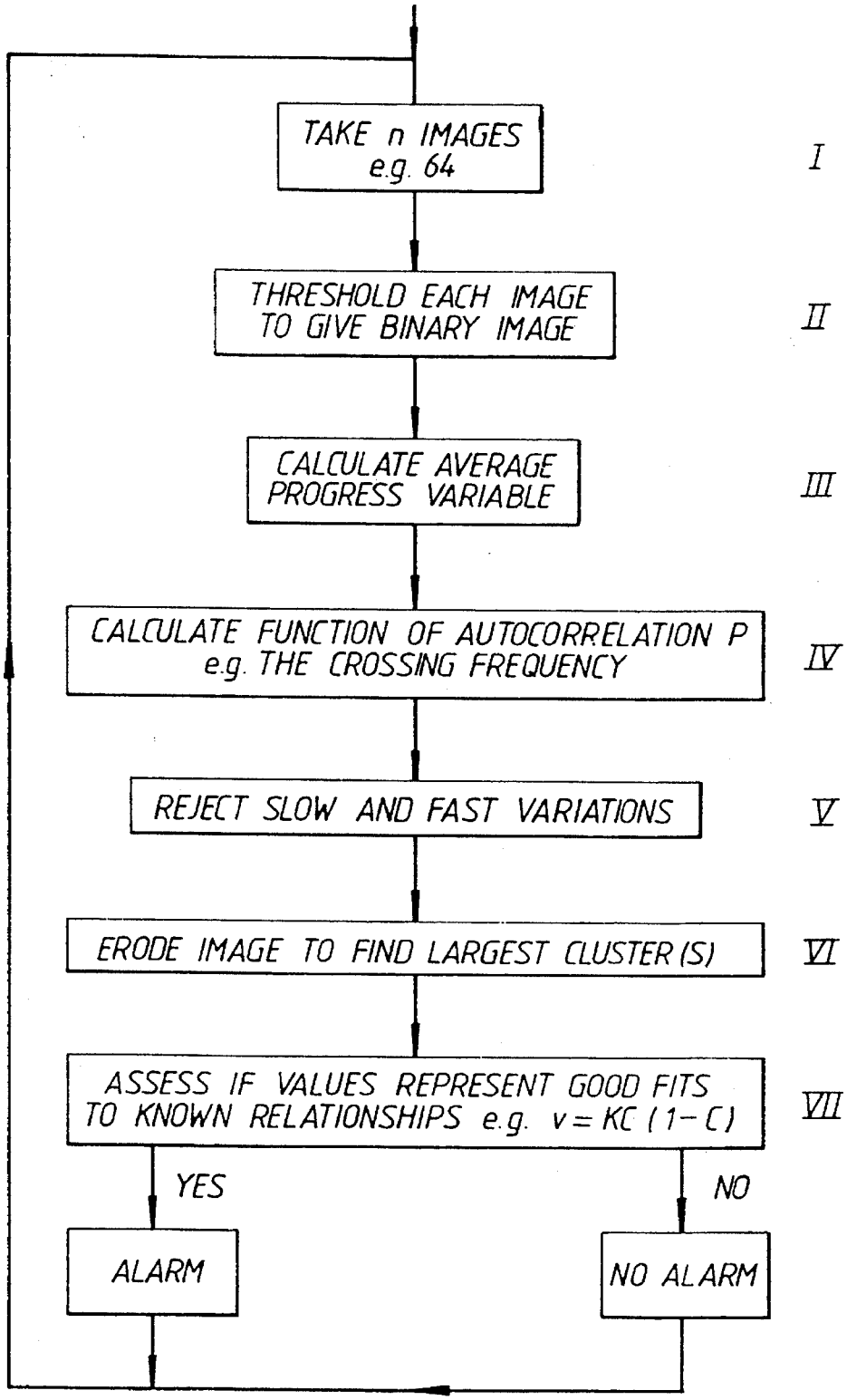
FIG. 3 is a flow chart showing operations carried out in one form of the apparatus of FIG. 1.

The sequence of operations carried out will now be described in more detail with reference to FIG. 3.

Each image taken by the camera is made up of a matrix of pixels and the camera output for each pixel will be dependent on the intensity of the radiation received for that pixel. In the embodiment being described, the apparatus carries out the detection process for each successive sequence of n images (where n is greater than or equal to 8 and, preferably, greater than or equal to 32). In other words, the apparatus stores the intensity values for the pixels of each of n successive images and then processes these values in a manner to be described to detect whether these values indicate a flame. The process is then repeated for the next n images; and so on.

At Step I (FIG. 3), therefore, the first n successive images are taken. All the pixel values for each of these images can be stored. However, and as explained below, storage is not necessary.

At Step II, the average intensity for the whole of each image is calculated (but ignoring zero intensities). Thus, an average intensity value $I_1$ is produced for the first image, $F_1$, an average intensity value $I_2$ is produced for the second image, $F_2$; and so on for the remaining images. For each image, the actual intensity level in each of its pixels is compared with the average intensity value for the whole image and a binary value, 0 or 1 (corresponding to c), is assigned to each pixel according to whether its actual intensity value is less or greater than the average intensity value for the whole image. This process can be implemented by a look-up table.

However, it has been found that in the case where the camera is operating in the near infra-red (850 nm to 1.1 micrometers), there is no need to calculate the threshold intensity for each image. It appears to be sufficient to use the same threshold level (e.g. 10 on a scale of 0 to 225) for each image. This simplifies the procedure.

At Step III, the average progress variable C (as defined above) is then calculated for the corresponding pixels in each image. The binary value of a particular pixel in the first image $F_1$ is summed with the respective binary values for the same pixel in each of the other (n−1) images and the sum divided by n to give a value of C lying between 0 and 1 for that particular pixel (in all of the images). There will thus be n distinct possible values for C. The process is then repeated for the next pixel in the first image $F_1$ whose binary value is thus summed with the respective binary values for the same pixel in each of the other images and the sum again divided by n to give a value of C lying between 0 and 1 for those particular pixels. Thereafter, the process is repeated again in the same way for the remaining pixels.

At Step IV, the function (called P, see above) of the autocorrelation function of c is then calculated for the corresponding pixels in each image. The crossing frequency v is an example of this. The binary value of a particular pixel in the first image $F_1$ is compared with the respective binary values for the same pixel in each of the others of the n images and a count taken of the number of transitions between 0 and 1, which is then divided by n. In this way, n distinct values of v are possible. The process is then repeated for the next pixel in the first image $F_1$ whose binary value is thus compared with the respective binary values for the same pixel in each of the others of the n images and a count taken of the number of transitions between 0 and 1, which is then divided by n, thus producing a value of v for those pixels. Thereafter, the same process is repeated in the same way for the other pixels.

The apparatus may be arranged to capture and store the sequence of images. However, it is also possible, and may be preferable, to do all the thresholding, averaging and calculation of C, P and v in real-time as the data comes in, so dispensing with the need to store the complete sequence of images.

The n different values of v are then processed at Step V with the aim of eliminating values due to fluctuating sources other than flames. To this end, the value of v for each pixel is compared with upper and lower limit values in Step V. If v is between these two limit values, it is set to binary 1; otherwise, it is set to binary 0. In other words, values of v derived from very slowly or very rapidly fluctuating parts of the image are considered not to be derived from flames whereas values of v of intermediate flickering rate are deemed to be derived from flames. Flames in fact contain regions which fluctuate very slowly and very rapidly but they tend to have larger connected central regions which fluctuate at intermediate rates. Therefore, these regions are detected. The upper and lower limits are derived empirically and, in one example, are 0.28 and 0.44 respectively.

There is thus effectively produced a thresholded image in values of v (though the original image in values of v is preserved). In a typical case, there will be several clusters of pixels in such an image having values of v=1, separated, of course, by pixels where the value of v=0. The image can then advantageously (though not necessarily) be processed, at Step VI, to identify the largest cluster or clusters. A standard "erosion" procedure is used in order to do this. In this procedure, for each pixel in the binary image, the eight surrounding pixels are examined. If all eight pixels are equal to 1 then the pixel in the middle is kept as 1, otherwise it is set to zero. This is repeated for every pixel in the image to perform one complete erosion. This erosion procedure is repeated until there are no pixels left. Then the previous image (last non-zero erosion) is taken and the position(s) of the pixel(s) in this image indicate the position(s) of the cluster(s).

The next stage is to construct a binary matrix. This is a matrix of pixels which are either 1 or 0 and comprising a cluster of binary 1 pixels corresponding to the (or each) cluster identified by the erosion process described above. This process starts with the single cluster-identifying pixel determined by the erosion process. Firstly, the pixels immediately adjacent to this cluster-identifying pixel are considered. The corresponding pixels in the v-matrix are inspected. If their values lie between predetermined values, then the corresponding pixels in the binary matrix are set to 1, otherwise they are set to 0. The process is repeated for the next adjacent pixel in the binary matrix, and continued until the binary matrix has been completed. The binary matrix will thus comprise one or more clusters of binary 1's, each corresponding to an identified cluster. It is now necessary to test each such cluster and make an assessment whether it does indeed correspond to a flame or whether it perhaps corresponds to an event having some similarities with a flame but not actually being a flame.

In this way, the largest cluster or clusters is/are identified and, for this cluster or clusters, the values of C and v are known. For the or each cluster, the relevant values of C and function of P (e.g. v) are assessed (Step VII). If the values within the cluster satisfy known relationships, e.g. v=KC(1−C), then this is considered to indicate the presence of a flame. However, because of noise in the imaging system, the effects of light saturation and non-linearities in the camera, and the fact that the assumption that the flame behaves like a premixed turbulent flame may not be strictly correct, it is unlikely that the fits to the known relationships will be perfect. A suitable statistical test is therefore used to provide a reasonable statistical assessment of the results. If the fit for a particular cluster satisfies the statistical test, it is considered that the cluster represents a flame, and not some other radiation source. An alarm is therefore given. A suitable test is based on the chi-squared test. When applied to the relation v=KC(1−C) , this test involves taking for each pixel in a cluster the associated values of C and v and then applying a parabolic best fit. The chi-squared statistic is processed to produce a goodness of fit parameter (it should be noted here that some assumptions need to be made about the noise distribution). If this parameter is greater than a particular value, the cluster is accepted as a flame and an alarm signal is given. If the parameter is less than the particular value, the cluster is rejected and the algorithm repeats; all clusters must be tested. If required, there is an additional test which can be applied to the cluster data which involves the use of simple pattern recognition techniques on the shape of the cluster—the purpose of this is to determined whether the particular cluster shape comes from a family of predetermined flame shapes.

A second form of the apparatus will now be described.

Figure 1:
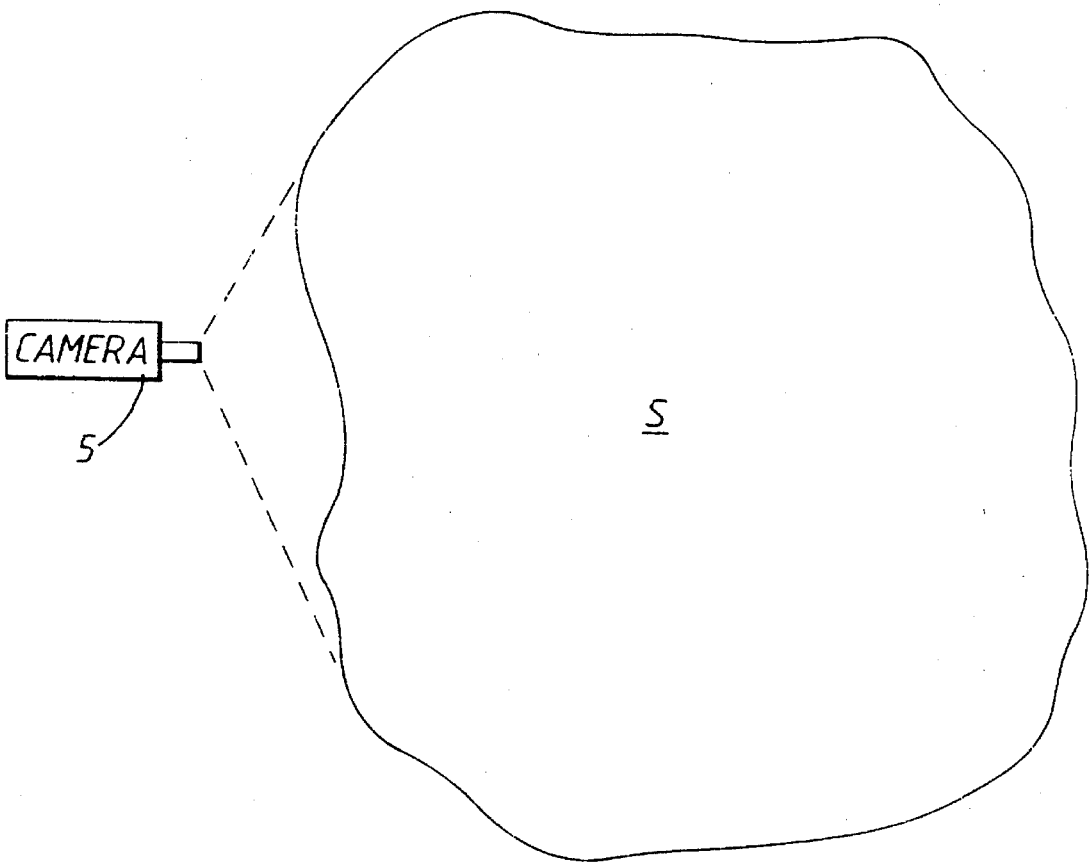
FIG. 1 is a schematic diagram of one form of the apparatus.

This form of the apparatus uses the camera 5 as shown in FIG. 1, the camera being of the same form as previously described—that is, operating separately in the near infra-red regions.

Figure 19:
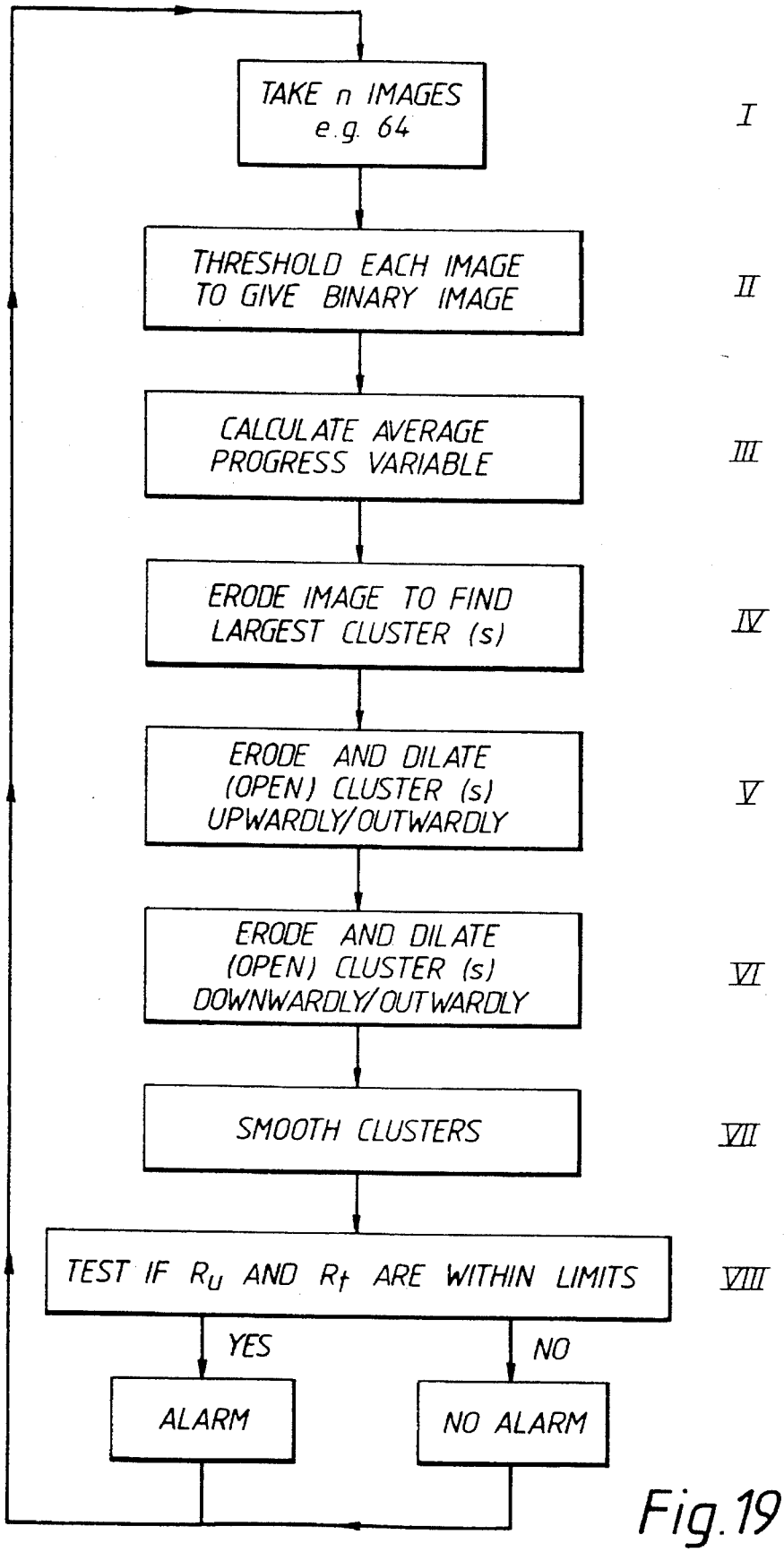
FIG. 19 is a flow chart showing operations carried out in the second form of the apparatus.

As before, the camera produces a sequence (e.g. 32 or 64 in number) of frames or images of the scene being viewed (see Stage I of FIG. 19). Successive such images are referred to as $F_1$, $F_2$, $F_3$ . . . $F_n$.

As for the first embodiment described above, each fixed point in space, x (see FIG. 2), is considered, and the intensity is measured for this point at each of a sequence of successive time instants, each corresponding to a respective one of the successive images (in the predetermined number of such images) produced by the camera. As explained above, the intensity is then thresholded to produce the progress variable c, where c=0 when there is unburnt mixture (reactants) at point x, and c=1 when the mixture at that point is fully burnt (products)—see Stage II of FIG. 19.

The camera thus produces a succession of images $F_1$, $F_2$, $F_3$ . . . $F_n$ each of which provides a matrix of 0 or 1 values for c, one such value for each point in the matrix. In the general case, where there may be no flame in the space S and perhaps no other fluctuating source of radiation, successive matrices may be identical. However, if a flame occurs within the space S, or some other source of fluctuating radiation, there will be corresponding changes (from 0 to 1) in the values of c for the corresponding points in the corresponding images. The output of the camera for the predetermined succession of images is processed by calculating the average value of c for each point in all the images. This average value of c will thus lie between 0 and 1 and is termed the "average progress variable", C. The result will therefore be the production of a single matrix in C, corresponding to the predetermined number of successive matrices in c from which it was produced (see Stage Ill of FIG. 19). This single matrix will be referred to below as the C-matrix.

In the first form of the apparatus described above with reference to FIG. 3, the output of the camera was also processed to produce the mean crossing frequency v and values of C and v were tested for the degree to which they satisfied the relationship in Equation (1) above. In the form now to be described, the mean crossing frequency v is not calculated and Equation (1) is not used.

Figure 4:
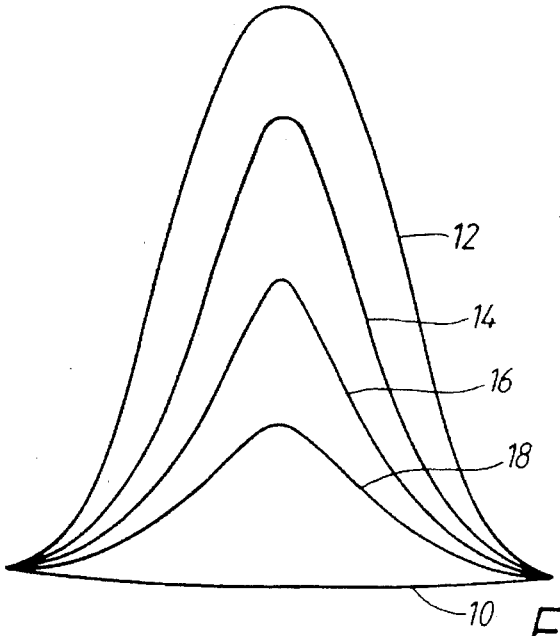
FIG. 4 is a diagrammatic illustration of a flame average formed from a sequence of flame images for the purposes of a second form of the apparatus of FIG. 1.

FIG. 4 shows the general form of the contours of C (that is, the lines respectively representing different but constant values of C) which will be produced in the C-matrix by a flame. In FIG. 4, the contour 12 represents the outer boundary region of the flame. Contours 14,16 and 18 represent regions within the flame along which the value of C is constant. It will be apparent that the value of C adjacent the boundary of the flame will be highest and contour 12 may correspond to a value of C=0.9, say. In contrast, the region adjacent the base of the flame will correspond to a low value of C, and contour 18 may thus correspond to a value of C=0.1. Contour 14 may thus correspond to a value of C=0.6, while contour 16 may correspond to a value of C=0.4, say. The contour map shown in FIG. 4 can thus be regarded as significantly representative of a flame and is distinguished from contour maps corresponding to other varying radiation. For example, arc welding would produce a contour map of the general form shown in FIG. 5, that is, substantially symmetrical about a central point. Compared with the contour map shown in FIG. 4, there would thus be contour lines for C below the central point as well as above it. The same would apply to other varying radiation sources, such as a moving light.

Therefore, in a manner to be described in more detail, the apparatus processes the C-matrix produced by the camera to check whether it incorporates a contour map having the general form shown in FIG. 4 (or, of course, more than one such contour map).

The first step in the processing of the C-matrix is the identification of any arid all cloisters of values of C in the image and which lie between 0.1 and 0.9, these values being experimentally selected as providing sufficient sensitivity but without spurious signals. It is necessary to identify each such cluster in order to facilitate subsequent processing.

Any such cluster is identified by a directional erosion process. In carrying out this process, each pixel in the C-matrix is individually considered and two tests, Test A and Test B, are applied to it, as described below. Each pixel must satisfy both tests. If it does, then its value is set to 1. If it does not satisfy both tests, then it is deleted from the matrix. (Such setting to 1 or deletion does not in fact destroy the C-matrix; a copy of it can be regarded as being retained for subsequent processing as will be explained).

Figure 6:
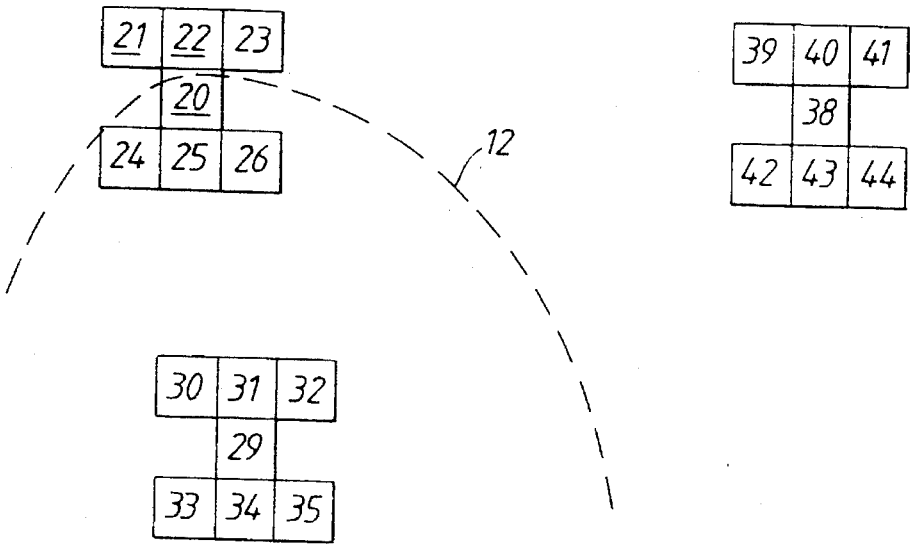
FIGS. 6 to 11 illustrate various operations carried out by the second form of the apparatus on images produced by the camera of FIG. 1.

In Test A, the values in the C-matrix of six pixels immediately adjacent each pixel under test are assessed. Unless all these six surrounding pixels have values of C lying between 0.1 and 0.9, the pixel under test does not pass the test. Referring to FIG. 6, there is shown a portion of the C-matrix and some of the corresponding pixels within that portion. It is assumed that a cluster of pixels corresponding to a flame is present, and the line 12 corresponds to the contour 12 in FIG. 4 representing the outer boundary of the flame and corresponding to C=0.9. Pixel 20 is a pixel being tested. In accordance with Test A, the C values for the six adjacent pixels 21 to 26 are assessed. It will be apparent that, of the six adjacent pixels, only the pixels 24, 25 and 26 will have C values lying between 0.1 and 0.9; the others are assumed to have values outside these limits. Therefore, pixel 20 is deleted—because it has failed Test A. Pixel 38 will also fail Test A because all six adjacent pixels 39 to 44 will have values outside the 0.1 to 0.9 limits.

In contrast, it will be seen that, when pixel 29 is tested, it will pass Test A because the C values for the six adjacent pixels 30 to 35 will all have C values lying within the limits of Test A. Pixel 29 will thus be set to 1—if it also satisfies Test B now to be described.

Figure 5:
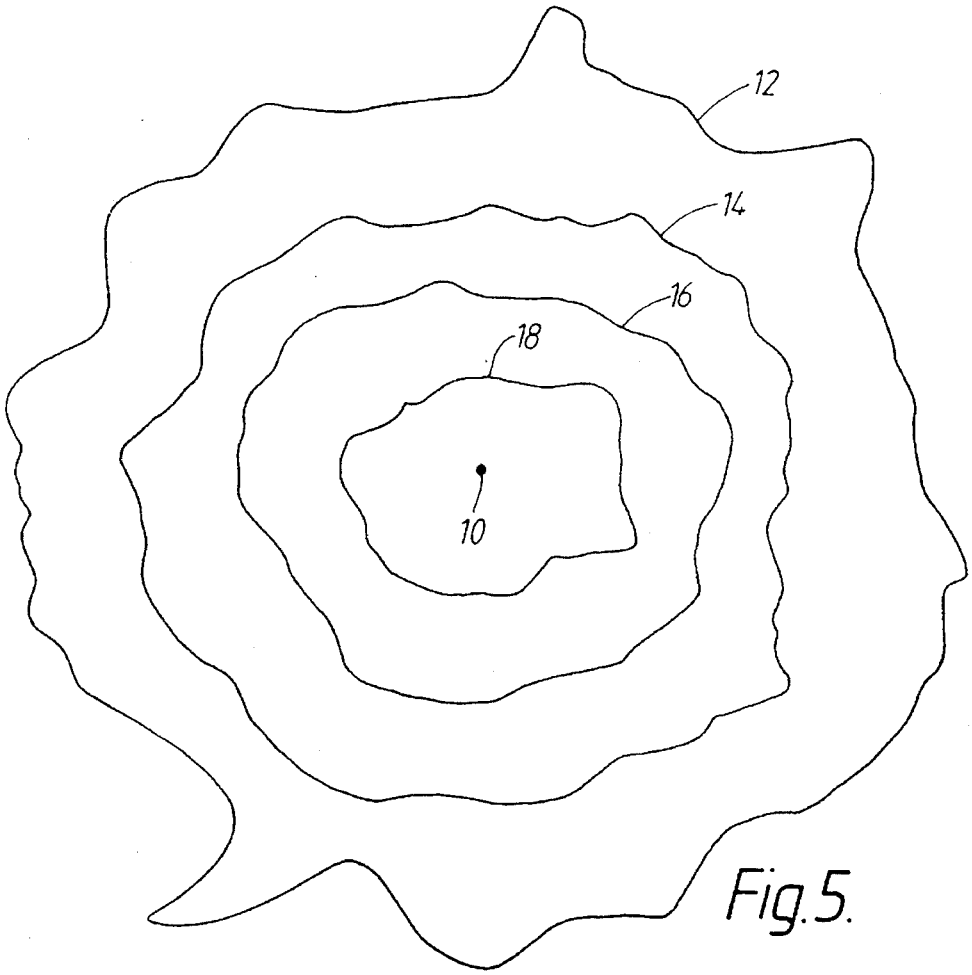
FIG. 5 corresponds to FIG. 4 but relates to a non-flame source of radiation.

Test B is a greyscale erosion process and compares the C values of the pixels adjacent to each pixel under test to assess whether their respective intensity values increase in a direction corresponding to a flame (see FIG. 4), or whether they vary in some other way, not corresponding to a flame. FIG. 4 shows that for a flame, the intensity values of individual parts of the image (corresponding to individual pixels in the C-matrix) increase in directions which are either vertically upward or upwardly and outwardly inclined from a base line 10. In contrast, FIG. 5 shows that for another source of radiation, the intensity values increase not only upwardly and outwardly but also downwardly and outwardly. Thus, referring to FIG. 7, which again shows part of the C-matrix, a cluster of pixels in the (C-matrix corresponding to a flame is shown within a line 12 corresponding to the C=0.9 contour 12 of FIG. 4. Pixel 48 is the pixel under test. The test involves three steps. One step involves comparing the values of pixels 53,48 and 50 to assess whether their intensity values (values of C) all successively increase in that order, that is, the direction of arrow A. The second step comprises comparing the intensity (C) values of pixels 52,48,51 to check whether they increase in that order, that is, in the direction of the arrow B. Finally, the C value of pixels 54,48 and 49 are assessed to check whether they increase in that order, that is in the direction of the arrow C. In each of these steps, strict increase must be detected—that is, no two of the three pixel values assessed can be the same.

Only if each of the three steps of the test is satisfied is Test B regarded as satisfied and pixel 48 is set to 1 (assuming, of course, that the corresponding pixel also satisfies Test A). It will be apparent from FIG. 7 that, for a flame, pixel 48 will satisfy Test B. This will be made clearer by cross-referring to FIG. 4 which illustrates not only contour 12 but the other contours as well.

Figure 8:
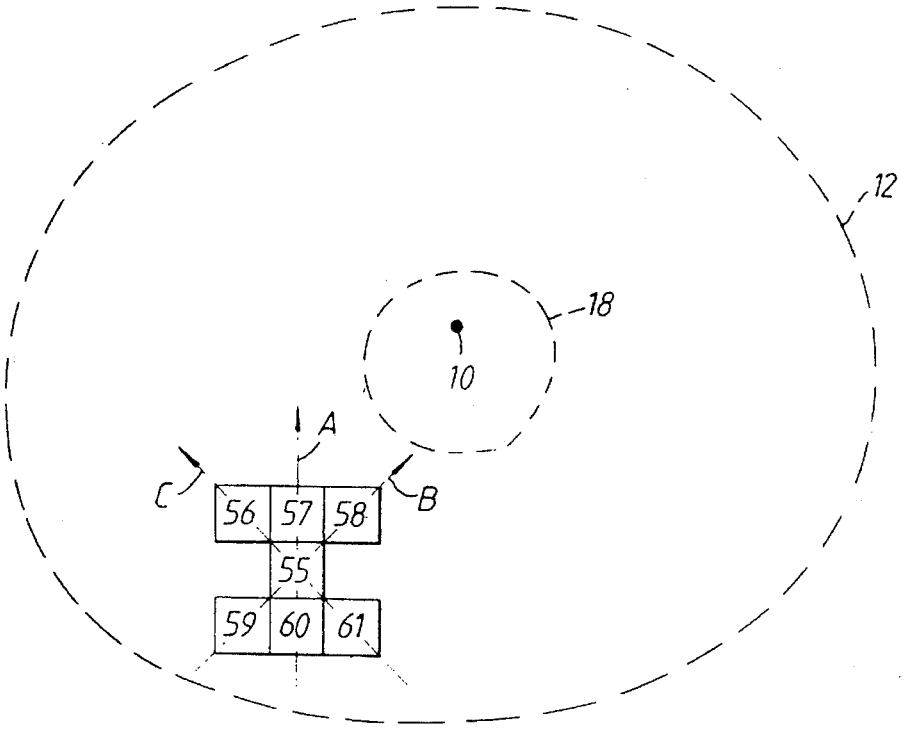

By way of contrast, FIG. 8 shows a pixel 55 under test within a cluster of values of C in the C-matrix corresponding to a pattern of radiation similar to that shown in FIG. 5 (e.g. from arc welding). It will be seen that pixel 55 (FIG. 8) will not be able to satisfy Test B, because the intensity values (C values) of the pixels adjacent to it will not increase in value in the direction of any of the arrows A,B and C. Pixel 55 is thus deleted.

For clarity, the contours 12, 18 in FIG. 8 are shown as being of generally regular shape whereas, in fact, they are of irregular shape as shown in FIG. 5.

After Tests A and B have been applied to all the pixels in the C-matrix (they are in fact carried out simultaneously), the result will be that, for any cluster of C values corresponding to a flame (e.g. as shown in FIG. 6), pixels around its boundary will have been deleted but pixels inside the cluster away from the boundary will be set to 1. Similarly, for any cluster corresponding to arc-welding and the like (see FIG. 7), pixels around its boundary will be deleted but pixels inside the cluster and away from the boundary will be set to 1 provided that they are above its centre but will otherwise be deleted. It will therefore be seen that any such cluster can be regarded as having been "eroded".

The process described above, involving the application of Tests A and B, is then repeated but only on the pixels in the C-matrix corresponding to those previously set to 1. Again, each pixel which does not satisfy both Tests A and B is deleted. The result at the end of this process will therefore again be a cluster of remaining pixels corresponding to any previous cluster but its outer region will have been "eroded". The process is then further repeated (again, only on the pixels in the C-matrix corresponding to those previously set to 1), each time "eroding" the boundary of any such cluster further—until eventually no pixels remain, all having been deleted. The position of the last-remaining pixel or pixels can thus be identified, that is, the pixel or pixels in the matrix as it existed immediately before the last remaining one or ones were deleted. The or each such pixel therefore indicates the approximate centre of the base of a cluster of pixels in the C-matrix. In this way (and corresponding to Stage IV in FIG. 19), the system has identified the general position of the or each cluster in the C-matrix and can now process the information in such cluster as will now be described.

Figure 7:
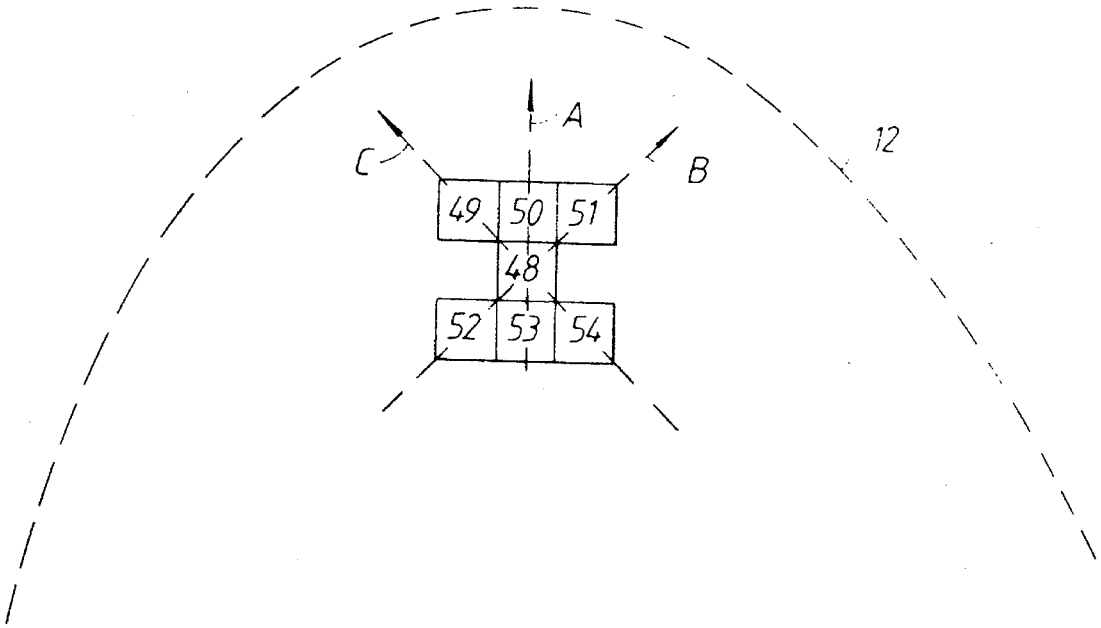

The next stage is to construct a binary matrix. This is a matrix of pixels which are either 1 or 0 and comprising a cluster of binary 1 pixels corresponding to the (or each) cluster identified in the C-matrix by the erosion process described above. This process starts with the single cluster-identifying pixel determined by the erosion process. Firstly, the pixels immediately adjacent to this cluster-identifying pixel are considered. The corresponding pixels in the C-matrix are inspected. If their C-values lie between 0.1 and 0.9, then the corresponding pixels in the binary matrix are set to 1, otherwise they are set to 0. The process is repeated for the next adjacent pixel in the binary matrix, by checking the C-values of the corresponding pixels in the C-matrix and setting the values of the pixels in the binary matrix 1 to if the C-values lie between 0.1 and 0.9. This process is continued until the binary matrix has been completed. The binary matrix will thus comprise one or more clusters of binary 1's, each corresponding to a cluster in the C-matrix. It is now necessary to test each such cluster and make an assessment whether it does indeed correspond to a flame or whether it perhaps corresponds to an event having some similarities with a flame but not actually being a flame (e.g. as shown in FIG. 7).

In this assessment process, each of the pixels in the C-matrix corresponding to a pixel having the value binary 1 in the binary matrix is considered in turn. For each such pixel in the C-matrix, the C-values of two of the immediately adjacent pixels are compared. Three separate greyscale tests are applied, Tests C,D and E. Test C is applied to all those pixels in the C-matrix which correspond to the binary 1 pixels in the binary matrix, then Test D is applied to all of them again, and finally Test E is applied to all of them.

Figure 9:
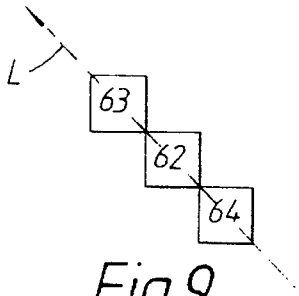

Test C is illustrated in FIG. 9. Pixel 62 is the pixel under test. Its C-value is compared with the C-values of the diagonally adjacent pixels 63 and 64. If the C-values all successively increase in the direction of the arrow L, the pixel in the binary matrix corresponding to pixel 62 is retained, otherwise it is deleted. As explained, this process is repeated for all the other pixels to be tested.

Figure 10:
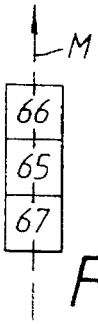

Test D is illustrated in FIG. 10. Here, pixel 65 is the pixel under test and its C-value is compared with the C-values of the vertically adjacent pixels 66 and 67. If the values are such that they all successively increase in the direction of the arrow M, the pixel in the binary matrix corresponding to pixel 65 is retained; otherwise, it is deleted. The process is repeated for all the other pixels under test.

Figure 11:
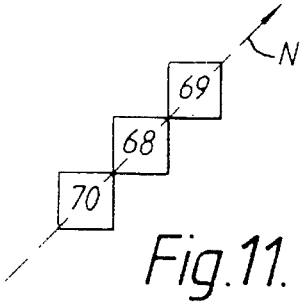

Test E is illustrated in FIG. 11. Here, pixel 68 corresponds to the pixel in the C-matrix under test. Its C value is compared with the C-values of the diagonally adjacent pixels 69 and 70. If the values all successively increase in the direction of the arrow N, the pixel in the binary image corresponding to pixel 68 is retained, otherwise it is deleted. Again, this test is repeated for all the pixels under consideration.

Unlike the erosion process described above with reference to FIGS. 6 and 7, the erosion process carried out by Tests C,D and E is carried out once, only, on all the pixels. In each of the Tests C, D and E, it is important to note that not only does each pixel under test have to have a binary 1 value in the binary matrix but so also does each pixel involved in each Test (that is, pixels 63, 64, 66, 67, 69 and 70).

Although reference has been made above to pixels in the binary matrix being "deleted", a copy of the binary matrix can be regarded as being stored for subsequent processing.

Figure 12:
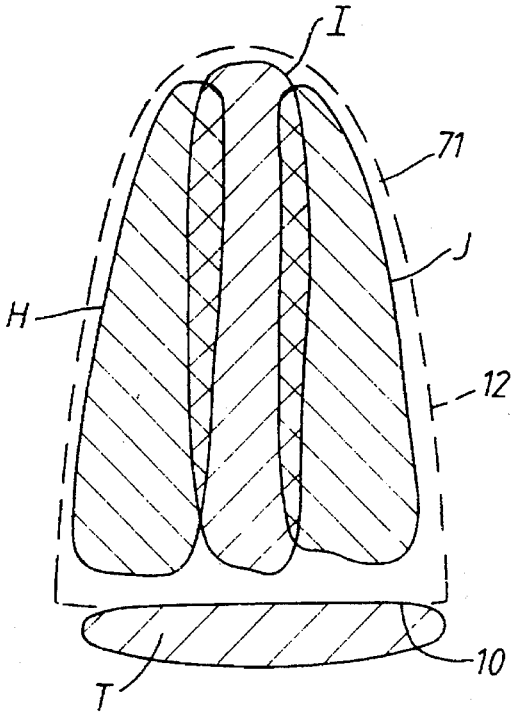
FIGS. 12 and 13 illustrate the results of these operations on radiation produced by a flame.

If the cluster of pixels in the binary image which is being tested represents a flame, then the result of tests (c),(d) and (e) will be as indicated in FIG. 12. The pixels within the cross-hatched area H will be those retained following Test C. Those within the cross-hatched area I will be those retained following test D. Those within the cross-hatched area J will be those retained after test E. The remaining pixels will be deleted. In FIG. 12, the line 12 corresponds to the contour 12 of FIG. 4, representing the outer boundary of the flame.

It will be noted that the areas H,I and J are spaced slightly inwards of the line 12 because the erosion process carried out by Tests C,D and E deletes the pixels along the boundary of the cluster. In order to eliminate the effect of this "gap" 71, a directional dilation or regrowing process is carried out. This involves a partial repeat of Tests C,D and E.

First, each pixel in the C-matrix corresponding to a pixel in the binary matrix which has been set to 1 following the erosion process described above with reference to FIGS. 9 to 11 is inspected and a comparison made of its C-value with the C-values of the immediately adjacent pixels. Each of these pixels is first inspected in the manner of Test C. Thus, if pixel 62 in FIG. 9 represents the pixel in the C-matrix under inspection, a check is made to see whether the diagonally adjacent pixels 63 and 64 have such values that the values of all the pixels successively increase in the direction of arrow L. If this is the case, then the pixels in the binary matrix corresponding to pixels 63 and 64, together with pixel 62, are set to 1. Otherwise, they are left unchanged. This process is repeated for all pixels set to 1 in the binary matrix.

A further inspection sequence then takes place in exactly the same way, but in the manner of Test D. Thus, if pixel 65 of FIG. 10 represents the pixel in the C-matrix under inspection, its C-value is compared with the C values of the vertically adjacent pixels 66 and 67 to check whether the values are successively increasing in the direction of the arrow M. If they are, the pixels in the binary matrix corresponding to pixels 66 and 67, together with pixel 65, are set to 1. Otherwise, their values are left unchanged. Again, this process is repeated for all the pixels having binary 1 values in the binary matrix.

Finally, the process is repeated in the manner of Test E, as shown in FIG. 11. Pixel 68 represents the pixel in the C-matrix under inspection. Its C-value is compared with C-values of the diagonally adjacent pixels 69 and 70 to check whether all three pixels have values which increase in the direction of the arrow N. If they do, pixels 69 and 70, together with pixel 68, are set to binary 1; otherwise they are left unchanged.

Figure 13:
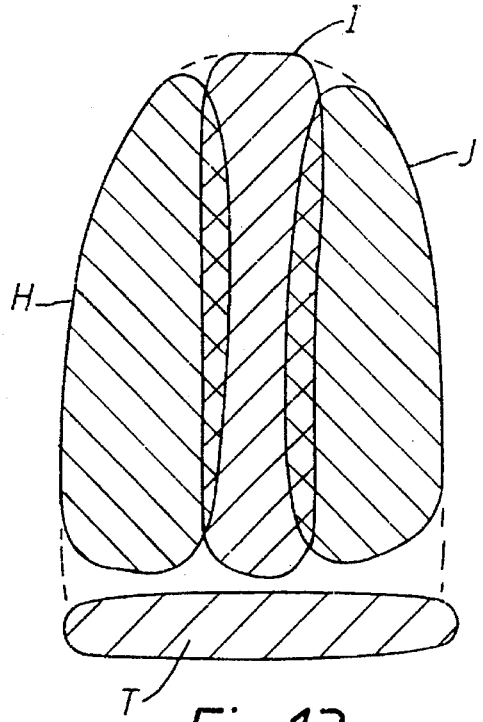

The result of this dilation process (where the cluster under inspection represents a flame) is to alter the areas H,I and J of FIG. 12 to those shown in FIG. 13; gap 71 of FIG. 12 has been partially eliminated.

The process of erosion followed by dilation as described above is called an "opening" and is indicated at Stage V in FIG. 19.

Figure 15:
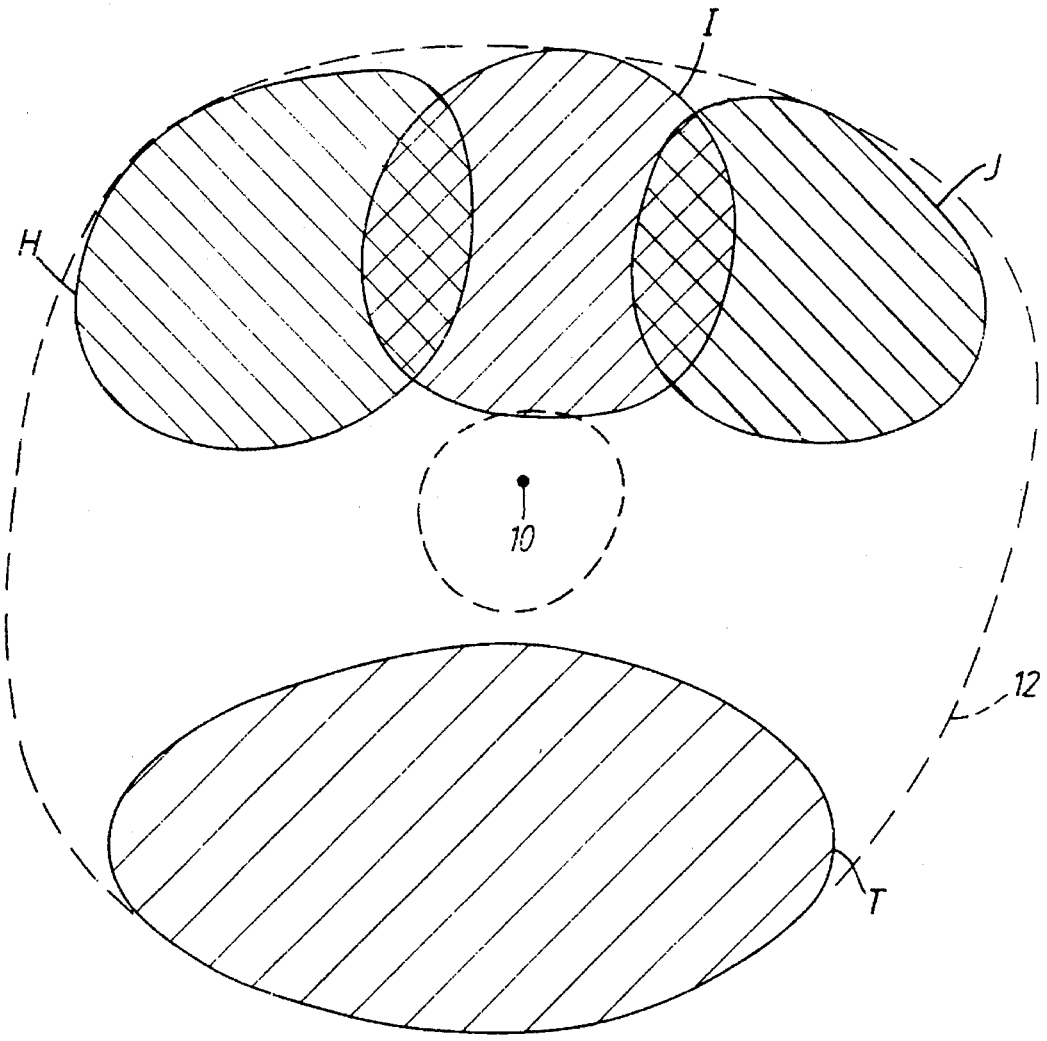

If the cluster under inspection is not a flame, then the resultant area or area of binary 1's in the binary matrix after conclusion of the "opening" process will of course have an appropriate shape or shape which may be different from that shown in FIG. 13. FIG. 15 shows corresponding areas H,I and J produced where the cluster corresponds to arc-welding (see FIG. 5).

As shown in FIG. 4, the C contours all lie on one side of ("above") the base 10 of the radiation pattern in the case of a flame, whereas for a source of radiation such as arc-welding as shown in FIG. 5, the C contours lie both above and below the centre or "base" of the pattern. In order to take account of this difference, the system now carries out a check on the (or each) cluster of pixels in the binary image (see FIG. 13) produced following Tests C,D and E with a view to assessing whether any C contours exist below the centre or base. A simplified form of the "opening" process described above with reference to FIGS. 12 and 13 is used.

Firstly, an erosion process is applied to all the pixels in the cluster by applying a further test, Test F, illustrated with reference to FIG. 14. Test F is applied to each pixel in the C-matrix corresponding to a pixel in the binary matrix having the value binary 1.

Figure 14:
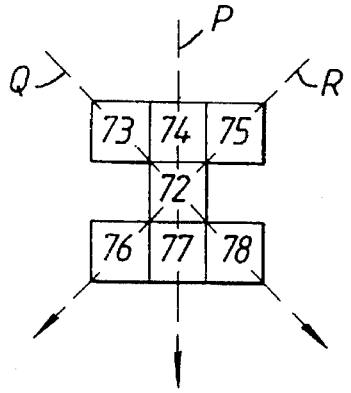
FIG. 14 illustrates a further operation carried out by the second form of the apparatus.

Referring to FIG. 14, if pixel 72 is the pixel in the C-matrix under test, its C-value is compared with the values of the immediately adjacent pixels 73,74,75,76,77 and 78 to check whether their values are all successively increasing in the directions of all three of the arrows P,Q and R. If this test is satisfied, then the pixel in the binary matrix corresponding to pixel 70 is set to (or retained at) binary 1. Otherwise, it is deleted. This process is repeated for all the pixels in the cluster. Clearly, all the pixels in the binary matrix corresponding to those within the areas H,I and J of FIGS. 12 and 13 will not satisfy Test F. However, on the assumption that the cluster under test represents a flame, though not a "perfect" flame in the sense of complying exactly with the configuration shown in FIG. 4, the result of Test F may be to produce binary 1 pixels constituting a small area T (FIG. 13). In carrying out Test F, each pixel involved in the test must have a binary 1 value in the binary matrix; that is, pixels 73, 74, 75, 76, 77 and 78 must all have binary 1 values as well as pixel 72.

If the cluster under test represents a pattern of radiation corresponding to FIG. 5 (e.g. arc-welding) however, the result of Test F will be to produce a significantly sized area T as shown in FIG. 15. For clarity, the contours 12, 18 in FIG. 15 are shown as being of generally regular shape whereas, in fact, they are of irregular shape as shown in FIG. 5.

Again, the erosion process carried out in accordance with Test F will be such that area T (FIG. 13 or 15) has in fact been eroded around its boundary. In order to complete the "opening" process, therefore, a dilation process is now carried out, generally following the format of Test F. Each of the pixels in the C-matrix corresponding to pixels in the binary matrix having the value binary 1 is inspected in turn in the manner of Test F. Thus, if pixel 72 of FIG. 14 is the pixel under assessment, its C-value is compared with C-values of the pixels 73 to 78 to check whether they increase in value in the directions of all of the arrows P,Q and R. Where such increases are detected, the pixels is set to binary 1; otherwise, it is left unchanged. Area T of FIG. 13 or FIG. 15, as the case may be, is therefore increased in size to offset its eroded boundary.

The result of the processing described above is thus to produce areas H,I,J and T of tested pixels—as shown in FIG. 13 if the event being monitored is a flame (FIG. 4) or as shown in FIG. 15 if the event is arc-welding or some similar pattern of radiation (FIG. 5). Of course, the event being monitored may not correspond to either FIG. 4 or FIG. 5; in such a case, a different and appropriate pattern of areas will be produced.

The overlapping areas H,I and J are then "amalgamated" to produce a composite area U (FIGS. 16 and 17). (FIG. 17, like FIGS. 8 and 1, shows the contours as being of regular shape instead of the actually irregular shape as shown in FIG. 5).

The foregoing process corresponds to Stage VI of FIG. 19.

A smoothing process is now carried out on the areas T and U, to fill in patches caused by abrupt changes in boundaries of the areas resulting from noise or other effects (see Stage VII of FIG. 19). This smoothing process initially involves a "dilation" process which is illustrated with reference to FIG. 18. The smoothing process is carried out on the binary matrix, thus taking no account of C-values. Each pixel in the binary matrix (FIGS. 16 or 17) is tested in turn. Referring to FIG. 18, if pixel 80 represents the pixel under test and is found to have a binary 1 value, then the eight immediately surrounding pixels are also set to binary 1. When this process has been completed, it is followed by an erosion process. Again, this is applied to each of the pixels in the binary matrix. Referring again to FIG. 18, if pixel 80 represents the pixel under test, it it set to binary 1, or maintained at that value, only if the binary values of the eight immediately surrounding pixels are also 1; if they are not all binary 1, then pixel 80 is deleted—that is, not regarded as lying within area T or U.

The final assessment test can now take place. Referring to FIGS. 16 and 17, it will be apparent that in the case where the cluster under test represents a true flame (FIGS. 4 and 16), area U will be large whereas area T will be very small. This is not the case where the cluster represents the radiation pattern of FIG. 5 as shown in FIG. 17. A final assessment test is therefore carried out by comparing the numbers of pixels in each of the areas T and U with the total number of pixels encompassed within the complete cluster. For example, two values $R_u$ and $R_t$ may be calculated where $R_u$ is the ratio (expressed as a percentage) of the number of pixels within the area U to the total number, V, of pixels within the entire cluster. Similarly, $R_t$ is the ratio of the number of pixels within the area T to the total number of pixels V, again expressed as a percentage. The values of $R_u$ and $R_t$ may then be compared with predetermined percentages to complete the assessment process. Thus, for example, if $R_u$ is equal to or greater than 85% (say) and $R_t$ is equal to or less than 15% (say), the cluster is deemed to represent a flame and an alarm is given. If both these conditions are not satisfied, no alarm is given. This corresponds to Stage VIII of FIG. 19.

Clearly, the limit values of 85% end 15% can be varied to suit particular circumstances.

What is claimed is:

1. A method of detecting flames within a monitored space, comprising the steps of:

viewing the space so as to produce a sequence of successive two-dimensional images of it in terms of the electromagnetic radiation received from it;

measuring the intensity of the radiation in each of a plurality of predetermined parts of each image, the parts of each image forming a two-dimensional array;

for each said part of all the images, comparing the measured intensity for that part with a predetermined threshold to produce a respective binary value for the intensity of that part, the binary value depending on whether the measured intensity is greater or less than the threshold, thereby producing a plurality of sets of binary values, each set comprising the binary values of a respective one of the parts in one image and of the correspondingly positioned part in each of the other images;

for each said set, calculating the average of its said binary values so as to produce a plurality of values for an average value parameter, each average value being the average of the binary values in a respective one of the sets;

each said set of binary values having an autocorrelation function;

for each said set, determining a value for a second parameter which is calculated in a predetermined manner from the autocorrelation function of the binary values in that set; and testing the said values of the average value parameter against those of the second parameter by determining whether a predetermined relationship exists between said values of respective parameters which occurs when the values of the respective parameters correspond to those values produced in the presence of a flame in the monitored space, thereby determining whether or not the said values indicate the presence of a flame.

2. A method according to claim 1, in which each said value of the second parameter is the mean frequency at which the binary values in a respective one of change.

3. A method according to claim 2, in which the step of determining the value of said second parameter for each said set comprises the step of determining for each respective one of the said sets a count of the number of transitions between one binary intensity value and the other, thereby determining said mean frequency for each respective said set.

4. A method according to claim 3, in which the value of the second parameter is not determined for any said set for which the mean frequency lies outside a range defined by predetermined upper and lower limit values.

5. A method according to claim 1, in which the said compelling step comprises the steps of comparing the measured intensity of each said part with a predetermined intensity which is the average of the measured intensities of all the parts of the image corresponding to that part, the predetermdined intensity constituting the said threshold.

6. A method according to claim 1, including a further testing step which comprises the step of comparing the pattern in which the values of the average value parameter are distributed with one or more predetermined patterns corresponding to flames, thereby determining whether or not the said values for the average value parameter indicate the presence of a flame.

7. A method according to claim 1, in which the electromagnetic radiation lies in the near infra-red region.

8. A method of detecting flames within a monitored space, comprising the steps of:

receiving electromagnetic radiation from the space;

producing a predetermined sequence of successive two-dimensional images of the space in which each image comprises a plurality of image parts each corresponding to a respective part of the said space, each image being represented by a respective plurality of image intensity values each of which values corresponds to the intensity of the electromagnetic radiation from a respective one of the parts of the space;

for each image, comparing the measured intensity value of each said image part with a threshold image value for that image, thereby assigning a binary intensity value to each image part, each binary intensity value depending on whether the measured intensity value is above or below the threshold value, thereby producing a plurality of sets of binary values, each set comprising the binary values of a respective one of the parts in one image and of the correspondingly positioned part in each of the other images;

for each said set, determining the average value of its said binary intensity values, thereby producing a collection of values of a parameter, the parameter being identified as an "average progress variable" (C);

for each set, determining the count of the number of times that its said binary intensity values change and dividing this count by the number of images so as to produce a value for a parameter identified as "crossing frequency" (v);

for each of selected ones of the image parts from all the images, testing the value of v and C by substituting them into the relationship $$v=KC(1-C)$$

where K is a constant; and signalling the existence of a flame for any cluster of adjacent image parts for which the respective values of v and C fit the said relationship within a predetermined statistical tolerance.

9. A method according to claim 8, further including the step of comparing the pattern in which the values of C are distributed in the said collection with one or more predetermined patterns corresponding to flames, thereby determining whether or not the said values indicate the presence of a flame.

10. A method according to claim 8, in which the selected ones of the image parts are those forming a cluster of adjacent image parts for each of which the value v has a value between predetermined upper and lower limit values which are such as to define a range corresponding to a flame.

11. A method according to claim 10, further including the steps of: determining the selected ones of the image parts by comparing the value of v for each image part with the values of the said predetermined upper and lower limit values thereby producing binary crossing frequency signals having one binary value when v lies between the limit values and the other binary value when v lies outside the limit values, producing a matrix in terms of these binary crossing frequency signals, and determining those of the image parts which correspond to the largest cluster in the matrix having the said one binary value.

12. A method according to claim 8, in which the electromagnetic radiation lies in the near infra-red region.

13. Apparatus for detecting flames within a monitored space, comprising:

means for viewing the space so as to produce a sequence of successive two-dimensional images of it in terms of the electromagnetic radiation received from it;

measuring means for measuring the intensity of the radiation in each of a plurality of predetermined parts of each image;

the parts of each image forming a two-dimensional array;

comparing means, operative for each said part of all the images, for comparing the measured intensity for that part to a predetermined threshold to produce a respective binary value for the intensity of that part, the binary value depending on whether the measured intensity is greater or less than the threshold, thereby producing a plurality of sets of binary values, each set comprising the binary values of a respective one of the parts in one image and the correspondingly positioned part in each of the other images;

calculating means for calculating, for each said set, the average of its said binary values so as to produce a plurality of values for an average value parameter, each average value being the average of the binary values in a respective one of the sets;

each said set of binary values having an autocorrelation function;

means for determining, for each said set of binary values, a value for a second parameter which is calculated in a predetermined manner from the autocorrelation function of the binary values in that set; and testing means for testing the said values of the average value parameter against those of the second parameter by determining whether a predetermined relationship exists between said values of the respective parameters which occurs when the values of the respective parameters correspond to those values produced in the presence of a flame in the monitored space, thereby determining whether or not the said values indicate the presence of a flame.

14. Apparatus according to claim 13, in which each said value of the second parameter is the mean frequency at which the binary values in a respective one of said sets change.

15. Apparatus according to claim 14, in which the means for determining the value of said second parameter for each said set comprises means for determining for each respective one of the sets a count of the number of transitions between one said binary intensity value and the other, thereby determining the said mean frequency for each respective said set.

16. Apparatus according to claim 15, in which the determining means does not determine the value of the second parameter for any said set for which the mean frequency lies outside a range defined by predetermined upper and lower limit values.

17. Apparatus according to claim 13, in which the said comparing means comprises means for comparing the measured intensity of each said part with a predetermined intensity which is the average of the measured intensities of all the parts of the image corresponding to that part, predetermined intensity constituting the said threshold.

18. Apparatus according to claim 13, further including means for comparing the pattern in which the values of the average value parameter are distributed with one or more predetermined patterns corresponding to flames, thereby determining whether or not the said values for the average value parameter indicate the presence of a flame.

19. Apparatus according to claim 13, in which the electromagnetic radiation lies in the near infra-red region.

20. Apparatus for detecting flames within a monitored space, comprising:

a camera for producing a predetermined sequence of successive two-dimensional images of the space in which each image comprises a plurality of image parts each corresponding to a respective part of the said space, each image being represented by a respective plurality of image intensity values each of which values correspond to the intensity of the electromagnetic radiation from a respective one of the parts of the image;

comparing means for comparing, in each image, the measured intensity value of each said image part with a threshold image value for that image, thereby assigning a binary image value to each image part, each binary image value depending on whether the measured intensity value is above or below the threshold value, thereby producing a plurality of sets of binary values, each set comprising the binary values of a respective one of the parts in one image and of the correspondingly positioned part in each of the other images;

means for determining, for each said set, the average value of its binary intensity values, thereby producing a collection of values of a parameter, the parameter being identified as an "average progress variable" (C);

means for determining, for each said set, the count of the number of times that its binary intensity values change and for dividing this count by the number of images so as to produce a value for a parameter identified as "crossing frequency" (v);

means for testing, for each of selected ones of the image parts from all the images, the values of v and C by substituting them into the relationship $$v=KC(1-C)$$

where K is a constant; and means for signalling the existence of a flame for any cluster of adjacent image parts for which the respective values of v and C fit the said relationship within a predetermined statistical tolerance.

21. Apparatus according to claim 20, further including means for comparing the pattern in which the values of C are distributed in the said collection with one or more predetermined patterns corresponding to flames, thereby determining whether or not the said values indicate the presence of a flame.

22. Apparatus according to claim 20, further including means for determining those adjacent image parts of said selected ones of the image parts for each of which the value v has a value between predetermined upper and lower limit values which are such as to define a range corresponding to a flame.

23. Apparatus according to claim 22, including further comparing means for comparing the value of v for each image part with the values of the said predetermined upper and lower limit values thereby producing binary crossing frequency signals having one binary value when v lies between the limit values and the other binary value when v lies outside the limit values, means for producing a matrix in terms of the binary crossing frequency signals, and means for determining those of the image parts which correspond to the largest cluster in the matrix of binary crossing frequency signals having the said one binary value, such image parts corresponding to the said selected ones.

24. Apparatus according to claim 20, in which the electromagnetic radiation lies in the near infra-red region.

25. A method of detecting flames within a monitored space, comprising the steps of:

viewing the space so as to produce a sequence of successive two-dimensional images of it in terms of the electromagnetic radiation received from it;

measuring the intensity of the radiation in each of a plurality of predetermined parts of each image, the parts of each image forming a two-dimensional array; each part corresponding to a respective point in the space;

for each said part of all the images, comparing the measured intensity for that part with a predetermined threshold to produce a respective binary value for the intensity of that part, the binary value depending on whether the measured intensity is greater or less than the threshold, thereby producing a plurality of sets of binary values, each set comprising the binary values of a respective one of the parts in one image and of the correspondingly positioned part in each of the other images;

for each said set, determining the average of its said binary values so as to produce a resultant plurality of the said average values, each average value being the average of the binary values in a respective one of the sets;

inspecting the average values in the plurality and identifying a cluster of average values exceeding a predetermined threshold, assessing the pattern in which the magnitudes of the average values are distributed within that cluster, and comparing that pattern with a predetermined pattern to determine whether the magnitudes of the average values in the plurality indicate the presence of a flame in the space.

26. A method according to claim 25, in which the step of identifying the said cluster of average values comprises the step of locating a cluster of average values in the plurality which corresponds to a cluster of particular parts in each of the said images such that the average values in the identified average value cluster lie between upper and lower limits which are selected in relation to those corresponding with a flame, and such that the average values within the identified average value cluster are distributed in a pattern corresponding with the pattern which would be produced by the presence of a flame in the monitored space.

27. A method according to claim 26, in which the locating step comprises the steps of arranging the average values relative to each other in an average value matrix such that each value in the matrix corresponds to a respective one of the parts of one of the two-dimensional images and to the same part of each of the others of the images, and thus to a respective one of the points in the space, whereby one or more clusters of average values may exist within the matrix in correspondence with one or more regions in the space from where radiation is emitted, and inspecting each said cluster of average values in the matrix to locate any one such cluster whose values have magnitudes lying between the said upper and lower limits and at least some of the values of which have upwardly and outwardly increasing magnitudes, where "upwardly and outwardly increasing magnitudes" are magnitudes which are progressively greater as the distances of the corresponding points in the space, from a predetermined point in the space, increase in directions upwardly, or having an upward component, with respect to that said predetermined point in the space.

28. A method according to claim 27, in which the step of inspecting each said average value cluster in the matrix comprises the steps of eroding the matrix by repeated steps of a binary erosion and a grayscale erosion whereby to produce a corresponding binary matrix of pixels having a cluster of like binary values which corresponds to the said identified average value cluster in the average value matrix, each pixel in the cluster of the same binary values being derived from and thus corresponding to a respective one of the average values in the identified average value cluster in the average value matrix and to a respective one of the parts of one of the two-dimensional images and to the same part of each of the others of the images, identifying those pixels in the cluster in the binary matrix which correspond to the values in the average value matrix having the said upwardly end outwardly increasing magnitudes, and identifying those pixels in the cluster in the binary matrix which correspond to the values in the average value matrix having downwardly and outwardly increasing magnitudes, "downwardly and outwardly increasing magnitudes" being magnitudes which are progressively greater as the distances of the corresponding points in the space, from the same or a different predetermined point in the space, increase in directions in the space downwardly, or having a downward component, with respect to said same or different predetermined point in the space; and in which the pattern assessing and comparison steps comprise the steps of determining first and second numbers of pixels respectively corresponding to the number of average values having the upwardly and outwardly increasing magnitudes and the number of average values having the downwardly and outwardly increasing magnitudes and determining whether or not to produce a flame indication in dependence on the respective said numbers.

29. A method according to claim 28, further including the steps of comparing the first number of pixels with the total number of pixels within the identified average value cluster to produce a first ratio, comparing the second number of pixels with the total number of pixels within that cluster to produce a second ratio, and producing a said flame indication when the first ratio exceeds a predetermined limit value and the second ratio is less than a predetermined limit value.

30. A method according to claim 26, in which the pattern assessing and comparing steps include the steps of determining the proportion of the number of values within the identified average value cluster whose distribution of magnitudes corresponds with the distribution expected from a flame, and determining whether or not to produce a flame indication in dependence on the magnitude of that proportion.

31. A method according to claim 26, in which the pattern assessing and comparing steps include the steps of determining the proportion of the number of values within the identified average value cluster whose distribution of magnitudes corresponds to a distribution not expected from a flame, and determining whether or not to produce a flame indication in dependence on the magnitude of that proportion.

32. A method according to claim 26, in which the pattern assessing and comparing steps comprise the steps of producing a first ratio of the number of values within the identified average value cluster whose distribution of magnitudes corresponds with the distribution expected from a flame to the total number of values within that cluster, producing a second ratio of the number of values within the identified average value cluster whose distribution of magnitudes corresponds with a distribution not expected from a flame to the total number of values within that cluster, and comparing each said ratio with a respective datum ratio value, so as to produce a flame indication only when each ratio has a value lying on a predetermined side of the respective ratio datum value.

33. A method according to claim 25, in which the electromagnetic radiation lies in the near infra-red region.

34. Apparatus for detecting flames within a monitored space, comprising:

means for viewing the space and producing a sequence of successive two-dimensional images of it in terms of the electromagnetic radiation received from it;

means for measuring the intensity of the radiation in each of a plurality of predetermined parts of each image, the parts of each image forming a two-dimensional array;

each part corresponding a respective point in the space, comparing means, operative for each said part of all the images, to compare the measured intensity for that part with a predetermined threshold to produce a respective binary value for the intensity of that part, the binary value depending on whether the measured intensity is greater or less than the threshold, thereby producing a plurality of sets of binary values, each set comprising the binary values of a respective one of the parts in one image and of the correspondingly positioned part in each of the other images;

processing means operative for each set to determine the average of its said binary values so as to produce a resultant plurality of the said average values, each average value being the average of the binary values in a respective one of the sets;

inspecting and identifying means for inspecting the average values in the plurality and identifying a cluster of average value exceeding a predetermined threshold, pattern assessing means for assessing the pattern in which the magnitudes of the average values are distributed within that cluster, and pattern comparing means for comparing that pattern with a predetermined pattern to determine whether the magnitudes of the average values in the plurality indicate the presence of a flame in the space.

35. Apparatus according to claim 34, in which the inspecting and identifying means comprises identifying means for identifying a cluster of average values in the plurality which corresponds to a cluster of particular parts in each of the said images such that the average values in the identified average value cluster lie between upper and lower limits which are selected in relation to those corresponding with a flame, such that the values within the identified average value cluster have a pattern of distribution of magnitudes corresponding with the pattern of distribution which would be produced by the presence of a flame in the monitored space.

36. Apparatus according to claim 35, in which the identifying means comprises means for arranging the average values relative to each other in an average value matrix such that each value in the matrix corresponds to a respective one of the parts of one of the two-dimensional images and to the same part of each of the others of the images, and thus to a respective one of the points in the space, whereby one or more clusters of average values may exist within the matrix in correspondence with one or more regions in the space from where radiation is emitted, and means for inspecting each said cluster of average values in the matrix to detect any such cluster whose values have magnitudes lying between the said upper and lower limits and at least some of the values of which have upwardly and outwardly increasing magnitudes, where "upwardly and outwardly increasing magnitudes" are magnitudes which are progressively greater as the distances of the corresponding points in the space, from a predetermined point in the space, increase in directions upwardly, or having an upward component, with respect to that said predetermined point in the space.

37. Apparatus according to claim 36, in which the means for inspecting each said average value cluster in the matrix comprises means for eroding the matrix by repeated steps of a binary erosion and a grayscale erosion whereby to produce a corresponding binary matrix of pixels having a cluster of like binary values which corresponds to the said identified average value cluster in the average value matrix, each pixel in the cluster of like binary values being derived from and thus corresponding to a respective one of the average values in the identified average value cluster in the average value matrix and to a respective one of the parts of one of the two-dimensional images and to the same part of each of the others of the images, means for identifying those pixels in the cluster in the binary matrix which correspond to the values in the average value matrix having the said upwardly and outwardly increasing magnitudes, and means for identifying those pixels in the cluster in the binary matrix which correspond to the values in the average value matrix having downwardly and outwardly increasing magnitudes, where "downwardly and outwardly increasing magnitudes" are magnitudes which are progressively greater as the distances of the corresponding points the space, from the same or a different predetermined point in the space, increase in directions in the space downwardly, or having a downward component, with respect to said same or different predetermined point in the space; and in which the pattern assessing and pattern comparing means comprise means for determining first and second numbers of pixels respectively corresponding to the number of average values having the upwardly and outwardly increasing magnitudes and the number of average values having the downwardly and outwardly increasing magnitudes and means for determining whether or not to produce a flame indication in dependence on the respective said numbers.

38. Apparatus according to claim 37, further including means for comparing the first number of pixels with the total number of pixels within the identified average cluster to produce a first ratio, means for comparing the second number of pixels with the total number of pixels within that cluster to produce a second ratio, and means for producing a said flame indication when first ratio exceeds a predetermined limit value and the second ratio is less than a predetermined limit value.

39. Apparatus according to claim 35, in which the pattern assessing and pattern comparing means include means for determining the proportion of the number of values within the identified average value cluster whose distribution of magnitudes corresponds with the distribution expected from a flame, and means for determining whether or not to produce a flame indication in dependence on the magnitude of that proportion.

40. Apparatus according to claim 35, in which the pattern assessing and pattern comparing means include means for determining the proportion of the number of values within the identified average value cluster whose distribution of magnitudes corresponds to a distribution not expected from a flame, and means for determining whether or not to produce a flame indication in dependence on the magnitude of that proportion.

41. Apparatus according to claim 35, in which the pattern assessing and pattern comparing means comprise means for producing a first ratio of the number of values within the identified average value cluster whose distribution of magnitudes corresponds with the distribution expected from a flame to the total number of values within that cluster, means for producing a second ratio of the number of values within the identified average value cluster whose distribution of magnitudes corresponds with a distribution not expected from a flame to the total number of values within that cluster, and comparing means operative to compare each said ratio with a respective datum ratio value, so as to produce a flame indication only when each ratio has a value lying on a predetermined side of the respective ratio datum value.

42. Apparatus according to claim 34, in which the electromagnetic radiation lies in the near infra-red region.

* * * * *